US005092241A

United States Patent [19]

Feser et al.

[11] Patent Number: 5,092,241

[45] Date of Patent: Mar. 3, 1992

[54] IMPRESSION CYLINDER ARRANGEMENT OF AN INTAGLIO MACHINE FOR A WEB-FED PRINTING

[75] Inventors: Norbert A. Feser, Goessenheim; Wolfgang L. Scheller, Oberpleichfeld, both of Fed. Rep. of Germany

[73] Assignee: De La Rue Giori S.A., Lausanne, Switzerland

[21] Appl. No.: 676,807

[22] Filed: Mar. 28, 1991

[30] Foreign Application Priority Data

Apr. 6, 1990 [CH] Switzerland ..... 1181/90

[51] Int. Cl.[5] ..... B41F 9/06; B41F 23/04

[52] U.S. Cl. ..... 101/153; 101/487; 165/6; 165/86; 165/89

[58] Field of Search ..... 101/487, 424.1, 348, 101/153, 489; 165/89, 86, 6; 34/62, 66, 67; 62/119; 118/59, 60

[56] References Cited

U.S. PATENT DOCUMENTS

| | | | |
|---|---|---|---|
| 3,749,015 | 7/1973 | Leatherman | 101/489 |
| 4,532,863 | 8/1985 | Bavoux et al. | 101/153 |
| 4,920,881 | 5/1990 | Tafel | 101/488 |

*Primary Examiner*—Edar S. Burr
*Assistant Examiner*—Moshe I. Cohen
*Attorney, Agent, or Firm*—Kane, Dalsimer, Sullivan, Kurucz, Levy, Eisele and Richard

[57] ABSTRACT

The arrangement has a device for cooling the impression cylinder (2) with a plurality of continuous metal belts (6) which run over two drums (4, 5) which partially wrap the impression cylinder (2) and are carried along by the latter during its rotation. These metal belts discharge the heat arising at the surface of the impression cylinder during the printing operation and are themselves cooled by the fact that one of the two drums (4) is constructed as a hollow cooling drum through which a cooling means flows. The drums (4, 5) are mounted in an adjustable frame (7) and, when the printing machine is switched off, can be removed from the impression cylinder (2) to the extent that the latter is not contacted by the metal belts (6).

10 Claims, 6 Drawing Sheets

IMPRESSION CYLINDER ARRANGEMENT OF AN INTAGLIO MACHINE FOR A WEB-FED PRINTING

FIELD OF THE INVENTION

The invention relates to an impression cylinder arrangement of an intaglio machine for web-fed printing. In web-fed printing it is important for the forme cylinder and the impression cylinder, between which the web of paper runs, to be kept at a virtually constant temperature during the printing operation so that the tension of the web of paper always remains constant, which is essential for achieving a satisfactory register. Undue heating of the forme cylinder and of the impression cylinder results in undesired changes in the dimensions.

PRIOR ART

In previously known intaglio machines for web-fed printing, only the forme cylinder is kept at a constant temperature by means of a liquid rotating in the interior of the cylinder, such as is known, for example, from EP-B-0,142,874, generally at a temperature of between 50° and 70° C., whereas a cooling of the impression cylinder by means of a cooling liquid rotating in its interior is not possible due to the special construction of this cylin-Impression cylinders of web-fed printing machines must have a smooth, continuous circumferential surface of a particular structure and, for reasons of stability, must have compact cylinder bodies which do not allow the installation of an internal cooling. Generally, impression cylinders of this type are constructed from a multiplicity of adjacent circular layers made of cotton or paper material which is compressed axially on both sides. A rubber coating is generally stretched over the circumference of the cylinder body thus formed. Impression cylinders having a surface coating made of plastic are also known (German Patent 2,050,663, corresponding to U.S. Pat. No. 3,691,949).

As experience has shown, these impression cylinders are now generally heated at the surface by the flexing work generated during the printing operation, specifically above the temperature which the forme cylinder is supposed to have as a constant temperature, with the result that the temperature of the forme cylinder is also raised. This undesired rise in temperature is generally about 10° C.

SUMMARY OF THE INVENTION

The underlying object of the present invention is to provide an impression cylinder arrangement which allows an effective cooling of the surface of the impression cylinder during the printing operation.

For achieving this object, the impression cylinder arrangement according to the invention has a device for cooling the impression cylinder with at least one continuous metal belt running over drums, which metal belt rests on the surface of the impression cylinder along a circumferential section of the latter and is movable at a speed corresponding to the circumferential speed of the impression cylinder and is subjected to a cooling.

Preferably a plurality of adjacently extending metal belts is provided which at least approximately cover the entire length of the impression cylinder.

In this manner, the heat generated at the surface of the impression cylinder is constantly discharged by the metal belts running off on the impression cylinder, with the result that the impression cylinder can be kept at a constant temperature which should preferably be about 10° C. below the constantly held temperature of the forme cylinder.

The drums are expediently freely rotatable and the metal belts are pressed so firmly against the impression cylinder that they are carried along by the rotation of said impression cylinder. One of the drums is preferably equipped as a cooling drum for a cooling liquid to pass through and it is pressed against the impression cylinder during the printing operation so that an intimate contact of the metal belts with the impression cylinder and said cooling drum is guaranteed.

In accordance with a preferred embodiment, the drums are mounted in an adjustable frame and, when the printing machine is switched off, can be removed from the impression cylinder to the extent that the latter is not contacted by the metal belts. In this case, the arrangement is expediently disposed such that, when the cooling device is actuated, the cooling drum firstly contacts the impression cylinder and then the metal belts come to rest on the circumference of the impression cylinder, but the other drum, which is provided with guide ribs for the metal belts, remaining at a short distance from the impression cylinder.

Further expedient developments of the arrangement according to the invention emerge from the dependent claims.

BRIEF DESCRIPTION OF THE DRAWINGS

The invention is explained in greater detail by way of an exemplary embodiment with reference to the drawings, in which.

DESCRIPTION OF THE PREFERRED EMBODIMENTS

Figure 1:
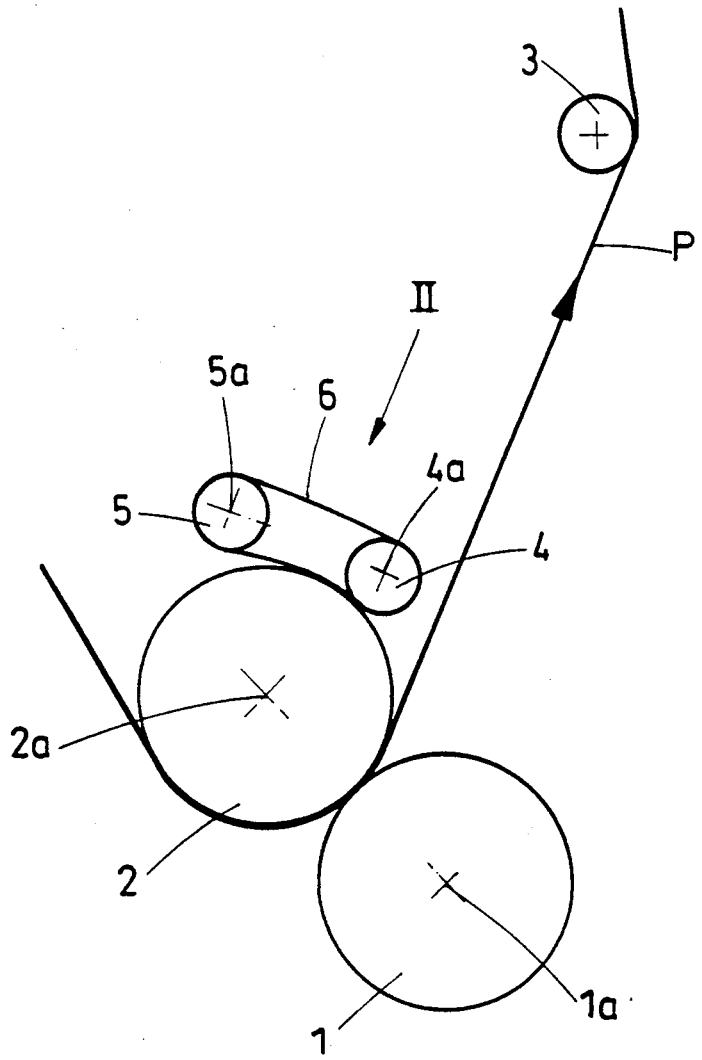
FIG. 1 shows an extremely simplified diagrammatic view of the impression cylinder arrangement according to the invention.
Figure 2:
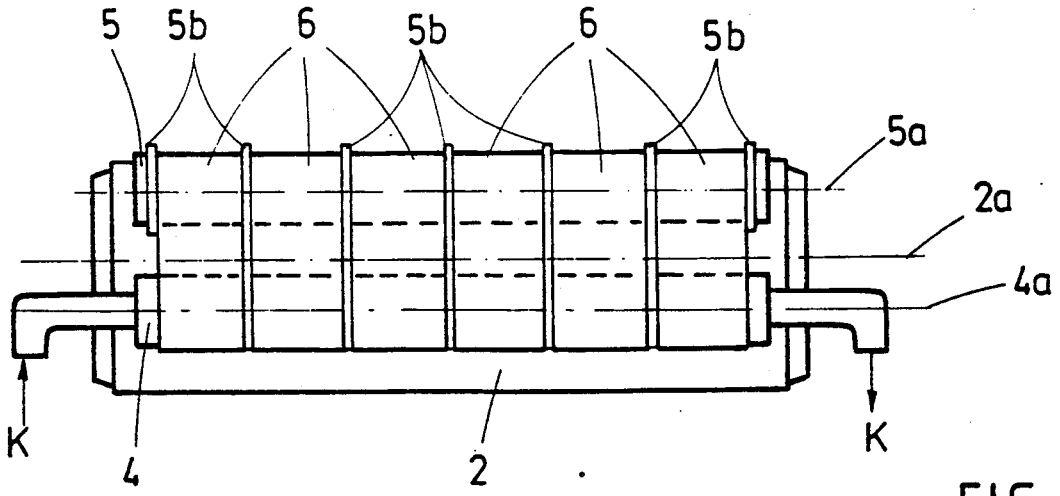
FIG. 2 shows a plan view in the direction of the arrow II of the metal belts.

The principle of the impression cylinder arrangement according to the invention can be seen from the extremely simplified illustration according to FIGS. 1 and 2. These figures show the forme cylinder 1, which is rotatable about the axis 1*a*, and the impression cylinder 2, which is rotatable about the axis 2*a*, of an intaglio machine (otherwise not illustrated in detail), the web of paper P which is moved in the direction of the arrow, which is printed when it passes the gap between the two cylinders, which are pressed against each other, and which subsequently runs over a tensioning roller 3, and the cooling device interacting with the impression cylinder 2. This cooling device has two drums 4 and 5 which are mounted in a common frame, which are freely rotatable about their axes 4*a* and 5*a* respectively, and via which adjacent continuous metal belts 6 run. In the example considered, according to FIG. 2 six continuous metal belts 6 are provided. During the printing operation, the frame, as is described in greater detail later, is positioned in such a way that the metal belts 6 are pressed with a predeterminable force against the circumference of the impression cylinder 2 and wrap the latter along a circumferential section, thereby being carried along by the impression cylinder during its rotation. In this manner, the metal belts 6 can discharge the heat which arises at the surface of the impression cylinder 2 and which is generated during the printing operation by the firm contact pressure of the impression cylinder 2 against the forme cylinder 1 and the flexing work thereby caused.

In order to cool the metal belts 6, in the example considered the one drum 4 is constructed as a hollow cooling drum, through which a cooling liquid flows, as indicated in FIG. 2 by the arrows K. In this manner, the surface temperature of the impression cylinder 2 can be kept at a constant value during the printing operation.

In order to guide the metal belts 6 laterally on the drums 4 and 5, one of the drums, in the example considered the non-cooled drum 5, is provided with annular ribs 5*b*, between which the metal belts 6 run. Due to these ribs 5*b*, the drum 5 should not contact the impression cylinder 2 in its operating position. In contrast, it is advantageous for the cooling drum 4 to be pressed directly against the impression cylinder 2 in the operating position of the cooling device, clamping the metal belts 6, in order to guarantee in this manner a particularly good contact of the metal belts 6 with the impression cylinder 2 on one side and the cooling drum 4 on the other side.

The cooling device, which is described in greater detail with reference to FIGS. 3 to 7, fulfills the conditions mentioned above, which cooling device is adjustable between a position of rest (FIG. 3), shifted away from the impression cylinder 2, in which the metal belts 6 do not contact the impression cylinder 2, and an operating position (FIG. 5), in which the cooling drum 4 rests on the impression cylinder 2, clamping the metal belts 6, whereas the other drum 5 has a small clearance from the impression cylinder 2, but it presses the metal belts 6 against the impression cylinder 2 along a particular circumferential section of said impression cylinder.

Figure 6:
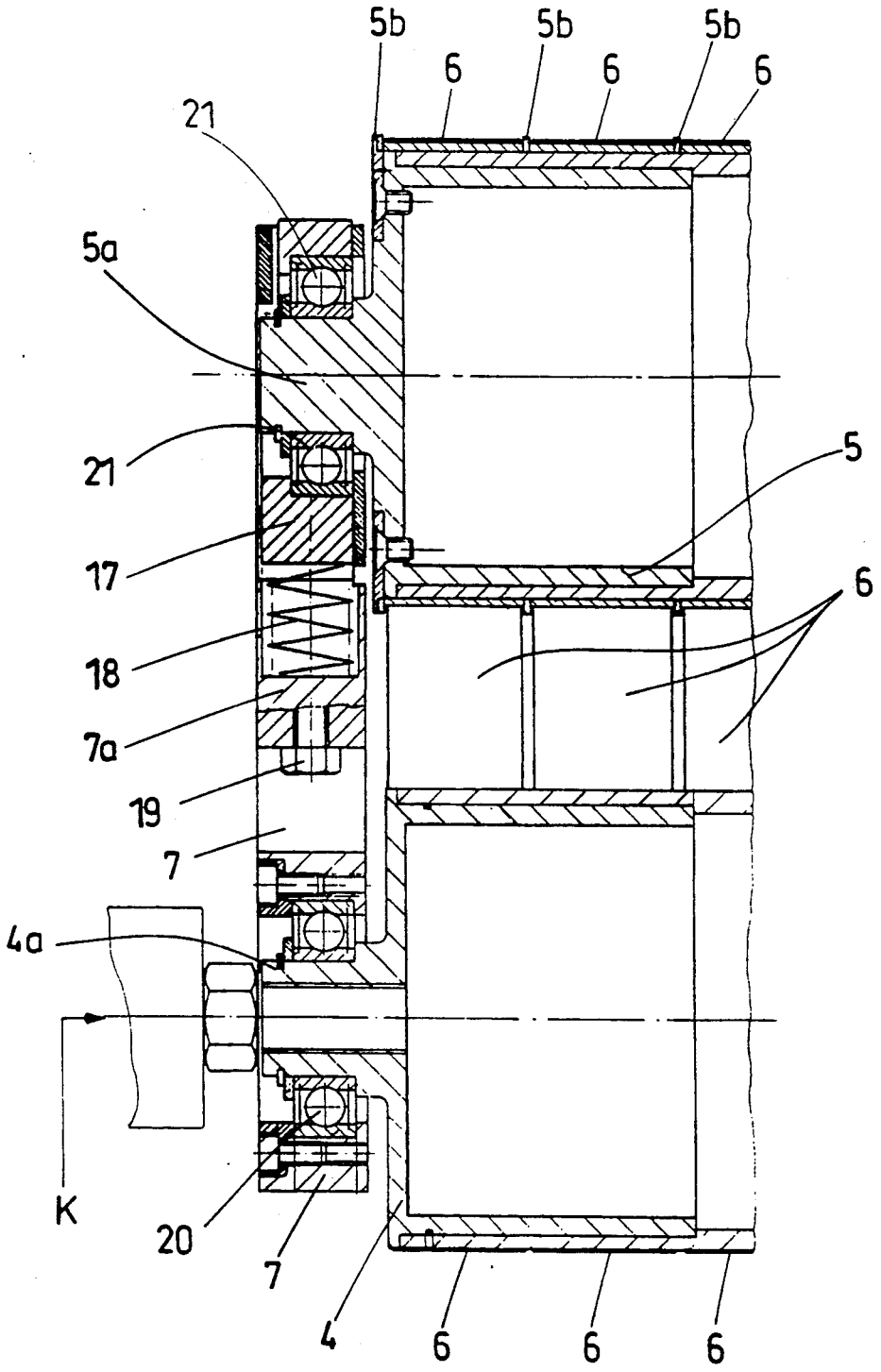
FIG. 6 shows a partial view of a section along VI—VI according to FIG. 4

As FIG. 6 shows, the drums 4 and 5 are installed in a frame 7. The drum 4 is mounted with its axis of rotation 4*a* in a bearing 20 and the other drum 5 is mounted with its axis of rotation 5*a* in a bearing 21. The bearing 21 is seated with each side in a sliding piece 17 which is displaceable in the frame 7 in the direction of the connection line between the two axes of rotation 4*a* and 5*a*. Arranged on both sides between a support 7*a* of the frame 7 and the sliding piece 17 in each case are pressure springs 18 which spread the two bearings and thus the two drums 4 and 5 apart and consequently keep the metal belts 6 running over the drums 4 and 5 permanently tensioned. The pressure springs 18 are each arranged on both sides next to screws 19 which each penetrate a hole in one part of the frame 7, are supported with their heads on this part and engage in a thread in the respective sliding piece 17. These screws 19 serve to displace the sliding pieces 17, in which the drum 5 is mounted, against the force of the pressure springs 18 in such a way that the distance between the drums 4, 5 can be reduced. This reduction in distance allows an easy exchangeability of the metal belts 6. After the exchange of the metal belts 6, the screws 19 are loosened to the extent that the metal belts 6 are only under the force of the pressure springs 18.

Figure 3:
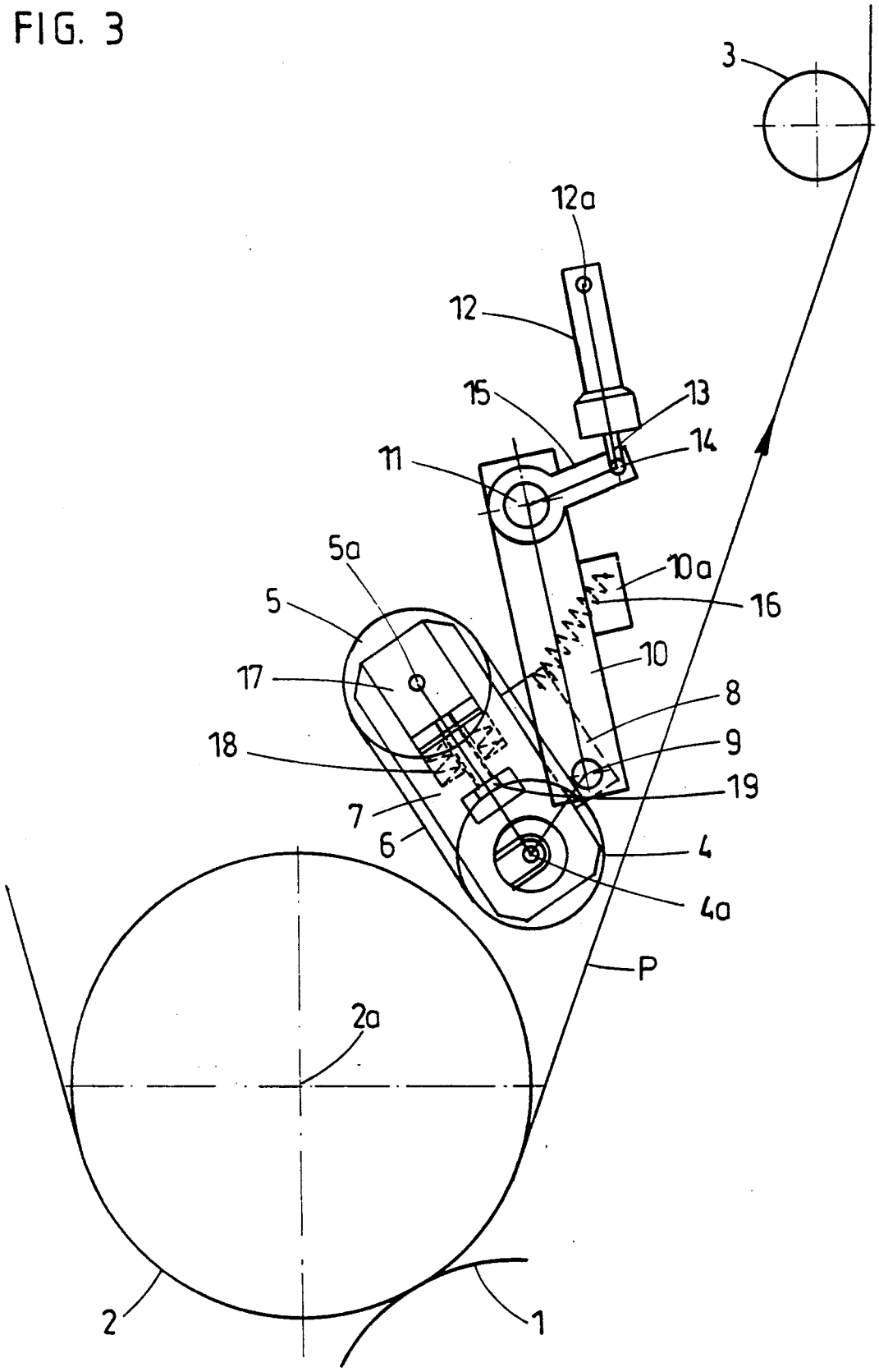
FIG. 3 shows a diagrammatic illustration of the arrangement with the cooling device, which can be shifted away from the impression cylinder, in the shifted-away position.
Figure 7:
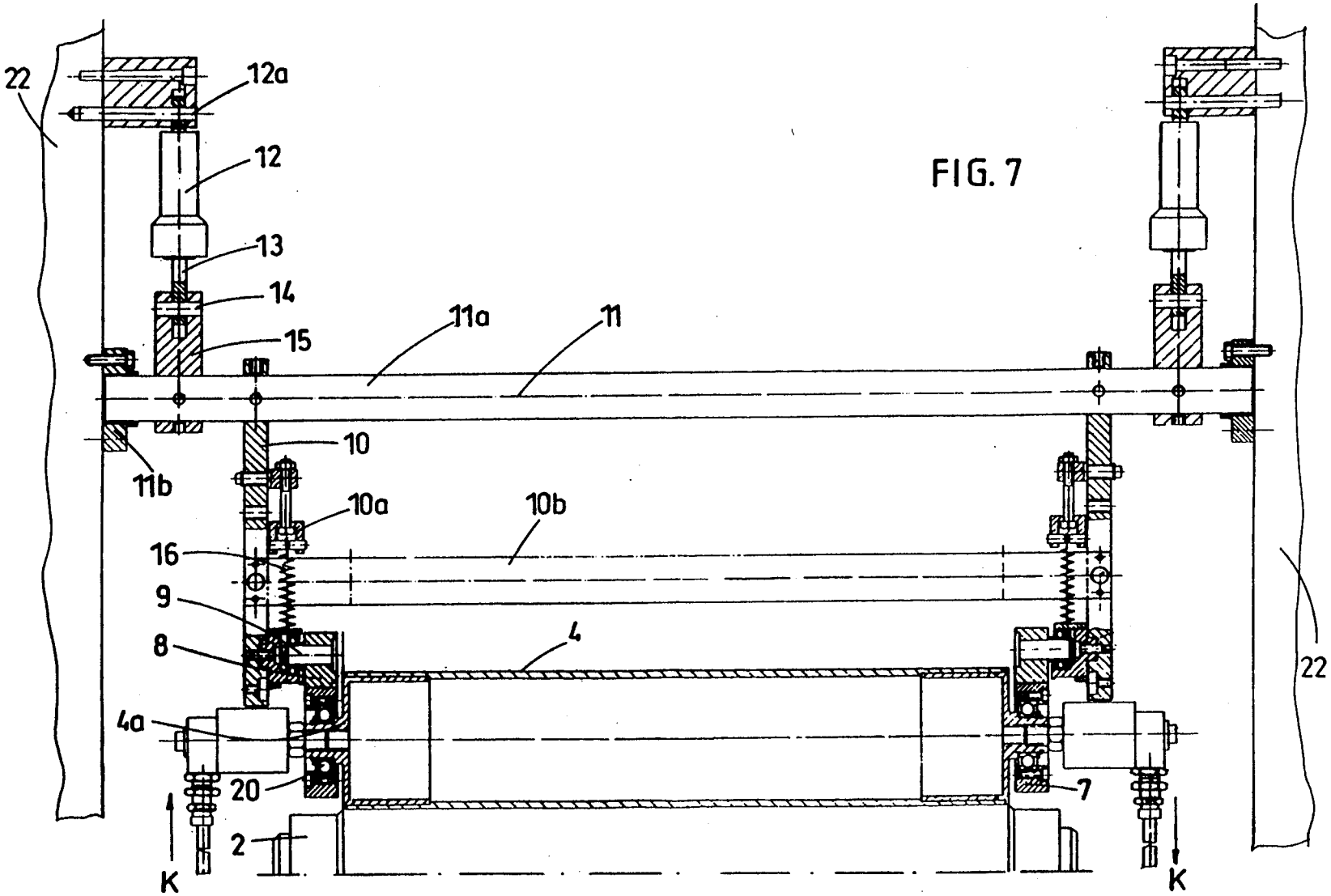
FIG. 7 shows a section along VII—VII according to FIG. 4.

The frame 7 is mounted outside its center, in the half exhibiting the cooling drum 4, on the one end of a lever arm 10 so as to be pivotable on each side about a free axis of rotation 9, the pivot point being situated on an attachment 8 of the frame 7 (FIGS. 3 and 7). The other end of each lever arm 10 is mounted on the stand 22 of the printing machine so as to be pivotable about a fixed axis of rotation 11. Both lever arms 10 are connected to each other by a cross-beam 10*b*.

The whole device is therefore suspended on the fixed axis of rotation which, according to FIG. 7, is incorporated by a shaft 11*a* mounted on the stand 22 so as to be rotatable in bearings 11*b*. Each lever arm 10 is pivotable about the fixed axis of rotation 11 with the aid of a pressure cylinder 12 which is mounted on the stand 22 so as to be rotatable by means of the pin 12*a*. The piston 13 of each pressure cylinder 12 is attached on a setting arm 15 in an articulated manner by means of a pin 14, which setting arm, in turn, is connected rigidly to the lever arm 10. For this purpose, the shaft 11*a* is connected at each of its ends on one side rigidly to the setting arm 15 and, on the other side, rigidly to the lever arm 10. A tension spring 16 is tensioned in each case on each side between the attachment 8 of the frame 7 and a projection 10*a* of the lever arm 10, which tension spring pulls the frame 7 upward in the direction of the lever arms 10.

In the example considered, the frame 7 consists of two side parts which are held together only by the drums 4 and 5 mounted therein. In this case, the cross-beam 10*b* provides additional stability and increases the rigidity against torsion of the lever arms 10 and of the shaft 11.

Figure 4:
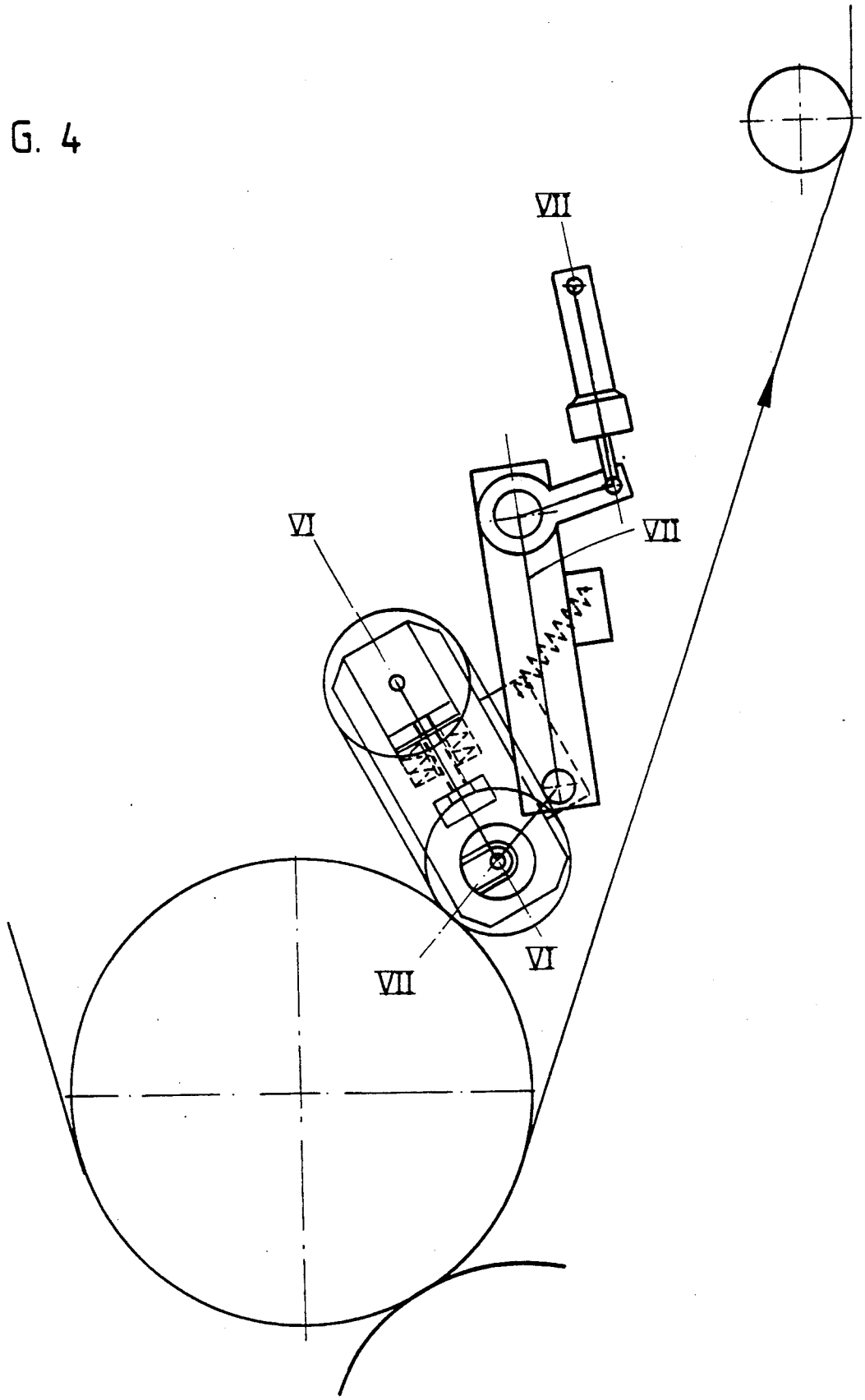
FIG. 4 shows an intermediate position of the cooling device during its actuation.

The connection line between the axis of rotation 4*a* and the drum 4 and the free axis of rotation 9 encloses an obtuse angle with the connection line between this free axis of rotation 9 and the fixed axis of rotation 11. Due to this configuration, when the cooling device is put into its operating position the following occurs: when the pressure cylinders 12 are activated and their pistons 13 are thereby extended, the lever arms 10 rotate, starting from the shifted-away position of the cooling device, shown in FIG. 3, in the clockwise direction about the axis of rotation 11 until, in an intermediate position, the drum 4 comes to rest on the impression cylinder 2. This intermediate position is illustrated in FIG. 4.

Figure 5:
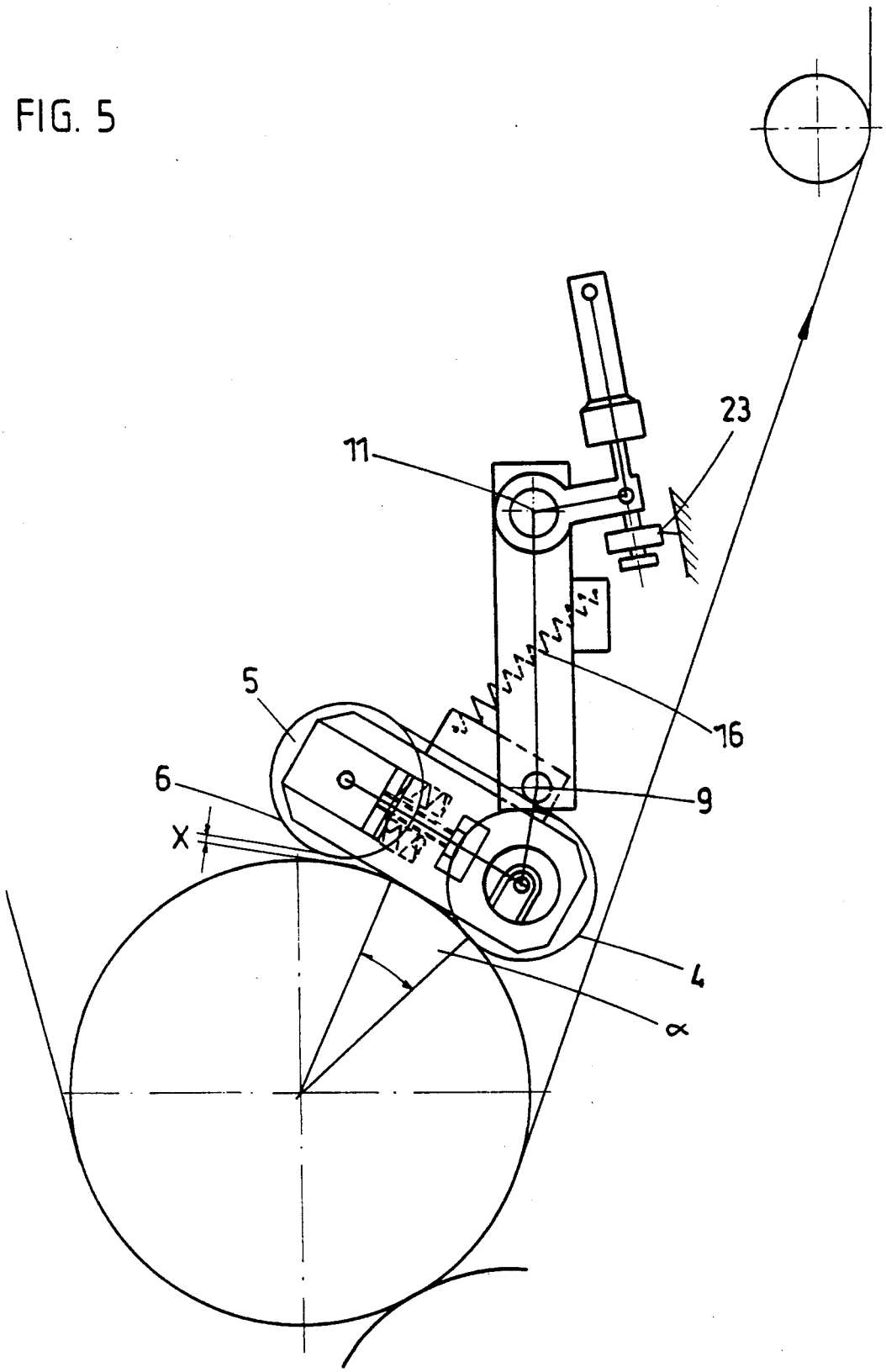
FIG. 5 shows the cooling device in its operating position after complete actuation.

Upon further swivelling of the lever arms 10, the frame 7 is now swivelled about the axis of rotation 4*a* of the drum 4 in the counterclockwise direction against the effect of the tension springs 16 to the extent that the metal belts 6, with contact pressure onto the impression cylinder 2, wrap the latter along a particular circumferential section, but without the drum 5, which has the annular ribs 5*b*, contacting the impression cylinder 2. This operating position is shown in FIG. 5, in which the wrapping angle $\alpha$ of the metal belts 6 is specified. This wrapping angle can be adjusted by stops 23 on both sides (FIG. 5). For switching off the cooling device, the lever arms 10 are pivoted in the counterclockwise direction about the fixed axis of rotation 11, by which means firstly under the effect of the tension springs 16 the frame 7 is swivelled upward, raising the drum 5 from the impression cylinder 2, and subsequently the drum 4 is also raised from the impression cylinder 2.

The invention is not restricted to the exemplary embodiment described, but it permits many variants in respect of the construction of the cooling device, in particular of the adjusting device for actuating and shifting the metal belts and in the number of the latter. For example, the arrangement can also be disposed in such a way that neither of the two drums rests on the impression cylinder in the operating position, but only the metal belts partially wrap the impression cylinder in the region between the two drums. The cooling of the metal belts can also be carried out in a different manner from that described.

We claim:

1. An impression cylinder arrangement for an intaglio machine used for web-fed printing, said arrangement comprising:

a rotating impression cylinder with a circumference and a surface section extending partially around said circumference; and cooling device for cooling said impression cylinder, said cooling device including a first and a second drum, a continuous metal belt running over said drums and cooling means for cooling said belt;

said belt being arranged to run at the same speed as said impression cylinder and being in contact with said surface section for cooling said impression cylinder.

2. Arrangement as claimed in claim 1, wherein a plurality of adjacently extending metal belts (6) is provided which at least approximately cover the entire length of the impression cylinder (2).

3. Arrangement as claimed in claim 1, wherein the drums (4, 5) are freely rotatable and the metal belt or the metal belts (6) are pressed so firmly against the impression cylinder (2) that they are carried along by the rotation of said impression cylinder.

4. Arrangement as claimed in claim 1, wherein at least one drum is equipped as a hollow cooling drum (4) for a cooling liquid to pass through.

5. Arrangement as claimed in claim 1, wherein at least one of the drums, which is preferably constructed as a cooling drum (4), can be pressed against the circumference of the impression cylinder (2).

6. Arrangement as claimed in claim 2, wherein at least one of the drums (5) is provided with annular ribs (**5*b*) which guide the metal belts (6**) adjacently.

7. Arrangement as claimed in claim 1, wherein an apparatus, which automatically tensions the metal belts, preferably a spring (18) spreading the two bearings (20, 21) of the drums (4, 5) apart, is provided.

8. Arrangement as claimed in claim 1, wherein the drums (4, 5) are mounted in an adjustable frame (7), when the printing machine is switched off, can be removed from the impression cylinder to the extent that the latter is not contacted by the metal belt or the metal belts.

9. Arrangement as claimed in claim 8, wherein the frame (7) is mounted outside its center, in the half exhibiting one of said drums equipped as a cooling drum (4), on the one end of a lever arm (10) so as to be pivotable about a free axis of rotation (9), the other end of which lever arm is mounted on the stand (22) of the printing machine so as to be pivotable about a fixed axis of rotation (11), wherein the connection line between the axis (**4*a*) of the cooling drum (4) and the free axis of rotation (9) encloses an obtuse angle with the connection line between the free axis of rotation (9) and the fixed axis of rotation (11), wherein a tension spring (16), which pulls the frame toward the lever arm, is tensioned between the frame (7) and the lever arm (10), and wherein the lever arm (10) is pivotable about its fixed axis of rotation (11) under the effect of an actuation force, preferably under the effect of a pressure cylinder (12), in such a way that the frame (7) is firstly moved from a position shifted away from the impression cylinder (2) until the cooling drum (4) is pressed against the impression cylinder (2), and is then pivoted about the free axis of rotation (9) against the force of the tension spring (16) to the extent that the metal belt or the metal belts (6) are pressed against the impression cylinder (2), but that the other drum (5) remains spaced away from the impression cylinder (2**).

10. Arrangement as claimed in claim 1, wherein the wrapping angle ($\alpha$) of the metal belt or the metal belts is adjustable by means of stops on both sides.

* * * * *